US007863508B2

(12) United States Patent
Bishop

(10) Patent No.: US 7,863,508 B2
(45) Date of Patent: Jan. 4, 2011

(54) STRING ALIGNMENT PEG

(76) Inventor: Dennis Bishop, 2889 Young Ave., Memphis, TN (US) 38111

( * ) Notice: Subject to any disclaimer, the term of this patent is extended or adjusted under 35 U.S.C. 154(b) by 0 days.

(21) Appl. No.: 12/387,926

(22) Filed: May 11, 2009

(65) Prior Publication Data

US 2010/0282041 A1 Nov. 11, 2010

(51) Int. Cl.
*G10D 3/12* (2006.01)

(52) U.S. Cl. ..... 84/297 R; 84/304

(58) Field of Classification Search ..... 84/297 R, 84/304

See application file for complete search history.

(56) References Cited

U.S. PATENT DOCUMENTS

| | | | | | |
|---|---|---|---|---|---|
| 554,057 | A * | 2/1896 | Durkee | 84/304 |
| 2,191,776 | A * | 2/1940 | Schreiber | 84/314 N |
| 2,260,049 | A * | 10/1941 | Nickel, Jr. | 84/297 R |
| 2,771,808 | A * | 11/1956 | Jenkins, Jr. | 84/304 |
| 4,006,657 | A * | 2/1977 | Dunnette | 84/314 R |
| 4,046,050 | A * | 9/1977 | Fender | 84/304 |
| 4,248,127 | A * | 2/1981 | Lieber | 84/314 N |
| 4,574,678 | A * | 3/1986 | Edwards | 84/314 N |
| 5,438,901 | A * | 8/1995 | Sperzel | 84/297 R |
| 5,696,336 | A * | 12/1997 | Sperzel | 84/314 N |
| 5,962,797 | A * | 10/1999 | Spercel et al. | 84/297 R |
| RE36,484 | E * | 1/2000 | Turner | 84/297 R |
| 6,444,886 | B1 * | 9/2002 | Spercel et al. | 84/297 R |
| 6,710,234 | B2 * | 3/2004 | Gregory | 84/312 R |
| 7,154,032 | B2 * | 12/2006 | Burchfield | 84/304 |
| 7,550,661 | B1 * | 6/2009 | Willis | 84/318 |
| 7,579,536 | B2 * | 8/2009 | Bonebrake | 84/312 R |

* cited by examiner

*Primary Examiner*—Elvin G Enad
*Assistant Examiner*—Robert W Horn
(74) *Attorney, Agent, or Firm*—David J. Kreher

(57) ABSTRACT

A String Alignment Plate for stringed instruments to reduce the excess friction in that portion of the string in the head region, generated at the nut of the instrument as a string passes through a notch of the nut and then bends in order to align with the tuning pin or machine head. The additional friction is created at the point of the bend where the string rubs excessively against the nut. This friction impedes tuning and results in differential tension of the string on either side of the nut. The String Alignment Plate is affixed to the head of the instrument and keeps the portion of the string in the head area in-line or parallel with that portion of the same string as it extends from the bridge to the nut, thus removing the bend. Once the string reaches the String Alignment Plate, the string curves around the Peg on the String Alignment Plate to the tuning peg or machine head.

3 Claims, 2 Drawing Sheets

STRING ALIGNMENT PEG

INTERNATIONAL CLASS

| Cross-Reference to Related Applications | | |
|---|---|---|
| 2,191,776 | February, 1940 | Schreiber |
| 2,771,808 | November, 1956 | Jenkins |
| 4,248,127 | February, 1981 | Lieber |
| 5,127,299 | July, 1992 | Stroh et al. |
| 7,579,536 | August, 2009 | Bonebreak |
| 7,550,661 | June, 2009 | Willis |
| 7,154,032 | September, 2002 | Spercel et al. |
| RE36,484 | January, 2000 | Turner |
| 5,962,797 | October, 1999 | Spercel et al. |
| 5,696,336 | December, 1997 | Sperzel |
| 5,438,901 | August, 1995 | Sperzel |
| 4,574,678 | March, 1986 | Edwards |
| 4,248,127 | February, 1981 | Lieber |
| 4,046,050 | September, 1977 | Fender |
| 4,006,657 | February, 1977 | Dunnette |
| 2,771,808 | November, 1956 | Jenkins |
| 2,260,049 | October, 1941 | Nickel |
| 2,191,776 | February, 1940 | Schreiber |
| 554,057 | February, 1896 | Durkee |

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

DESCRIPTION

1. Field of the Invention

This invention relates to the guitars and other stringed musical instruments where the strings of the instrument pass over a nut and then to a tuning peg or machine head. Specifically, the String Alignment Plate is intended to reduce the stress placed on that portion of the string after it passes over the nut and is angled from the nut to the tuning peg or machine head The additional tension on that portion of the string is the result of the increased friction between the nut and the string, as the string presses against the nut where the string bends in order to angle to the tuning peg or machine head. The additional friction causes that portion of the string above the nut to be at a different tension from that portion of the same string as it extends from the bridge to the nut.

The Peg(s) of the String Alignment Plate are cylindrical devices that are affixed to the truss rod cover to create the String Alignment Plate. The Pegs are affixed to the truss rod cover in such a manner that when the String Alignment Plate is affixed to the head of the instrument, each Peg forces a portion of the string above the Nut to remain in-line or parallel with that portion of the same string that extends from the bridge to the Nut. That portion of the string above the nut would then curve around the Peg to the appropriate tuning peg or machine head. The placement of and cylindrical nature of the Peg minimizes the friction caused when that portion of the string above the nut curves around the Peg, allowing consistent tension along the string from the bridge, through the nut and to the tuning peg or machine head.

The String Alignment Plate specifically addresses deficiencies of prior art in the area by minimizing the friction created when that portion of the string above the nut is angled from the nut to the tuning peg or machine head, and by maintaining similar amounts of tension along the entire length of the string; from the bridge to the tuning peg or machine head.

2. Background of the Invention

The String Alignment Plate was developed to minimize the friction created at the nut as that portion of the string above the nut bends at the nut of an instrument in order to reach the tuning peg or machine head and that portion of the string above the nut bends away from remaining in-line or parallel with the same string as it extends from the bridge to the nut along the neck of the instrument. The additional friction created by angling that portion of the string above the nut away from being in-line or parallel with the same string as it extends from the bridge to the nut causes differential tension along the string, whereby the string from the bridge to the nut possesses a different tension than that portion of the string above the nut that goes from the nut to the tuning peg or machine head. The differential tension causes the instrument to go out-of-tune more frequently because, over time, after the instrument has been tuned, the higher tension on the string between the nut and the tuning pegs equilibrates with the tension of the string between the bridge and the nut, and the balancing of the tension impacts the pitch of the string. The friction also makes the stringed instrument harder to tune because the pinch point at the nut does not allow the string to stretch evenly along its entire length as it is tightened.

Several attempts have been made to address the differential tension along the string of a musical instrument.

One common approach to resolving the problem of differential tension along a string of an instrument occurs when the instrument is strung. This occurs when, prior to attaching the string, graphite or another lubricating agent is applied to the notches of the nut. The lubricating agent is intended to act to decrease the overall amount of friction added at the pinch point, where that portion of the string above the nut is angled from the nut to the tuning peg or machine head. An alternative to the application of a lubricant is making the nut out of graphite or other like material.

In U.S. Pat. No. 2,191,776, Schreiber discloses a nut with slotted rollers in each of the notches of the nut. The rollers rotate as the string is tuned. However, this design only properly operates if the string above the nut remains in-line with the string below the nut. If the string above the nut angles away from being in-line with the string as it extends from the bridge to the nut, the roller may bind and/or the string will still rub against the edge of the notch, creating increased friction.

In U.S. Pat. No. 2,771,808, Jenkins discloses a banjo tuning device designed to allow the player to adjust the pitch of the instrument while playing and allow for the same pitch to be obtained each time the adjustment is made. However, this design is intended to adjust the pitch of an instrument, not to make it easier to establish or maintain a pitch.

In U.S. Pat. No. 4,248,127, Lieber discloses a string nut with rollers designed to allow the player to press down on the strings above the string nut, in order to allow the playing of special effects above the fretboard. However, this design may increase the amount of friction between the string nut and the tuning peg or machine head by shortening the distance from the string nut to the tuning peg or machine head and increasing and angle that must be created in order for the string to be attached to the tuning peg or machine head, while the string will still bind against the side of the notch of the string nut or against the roller at the base of the notch in the nut.

In U.S. Pat. No. 5,127,299, Stroh et al. discloses a string clamping mechanism whereby the strings are clamped in place at the nut. This is an alternative method of dealing with dual tension issue, which may not even work because once the strings are clamped, the clamping itself may adjust the pitch of the tuned strings, so that the strings are no longer in tune.

In U.S. Pat. No. 7,579,536, Bonebreak discloses a tension equalizer to maintain the same level of tension between the strings, to try to keep each strings pitch the same relative to the other strings. The String Alignment plate is distinct from Bonebreak because it eliminates differential tension within a single string, thus making the string easier to tune and allow the string to stay in tune longer.

In U.S. Pat. No. 7,550,661 Willis discloses a D-Tuner for Banjo to dynamically change the pitch on a banjo easily, quickly and accurately. The String Alignment plate is distinct from Willis because it is designed to allow a string to stay in tune longer by removing differential tension within a single string which otherwise causes a string to go out of tune, even if the instrument the string is attached to is not being played.

In U.S. Pat. No. 7,154,032 Burchfield discloses a set of bridge pins, saddles and nuts for stringed musical instruments to maximize contact between the string and the instrument, thus allowing a specific tone to be created. The String Alignment Plate is distinct from Burchfield because it is not concerned with the amount of contact between the string and the instrument, but with the elimination of differential tension within a single string, thus making the string easier to tune and allow the string to stay in tune longer.

In U.S. Pat. No. 6,444,886, Spercel et al. discloses a design for the head of a stringed musical instrument that allows the string to pass through the nut of the instrument and go straight to the machine head without the string being deflected before reaching the machine head. The String Alignment Plate is distinct from Spercel et al. because it does not redesign the head of the stringed instrument but allows the split head design to continue to be used while creating the same effect as the Spercel et al. design.

In U.S. Pat. RE36484, Turner discloses rotatable ball bearings that are in the notch of the nut or saddle of a stringed musical instrument and designed to dampen the amount of vibration that occurs between the nut and the tuning peg or machine head when a string is played. The String Alignment Plate is distinct from Turner because it is not concerned with the amount of contact between the string and the nut, and thus the amount of string vibration that occurs between the nut and the tuning peg or machine head, but with the elimination of differential tension within a single string, thus making the string easier to tune and allow the string to stay in tune longer.

In U.S. Pat. No. 5,962,797, Spercel et al. discloses a design for the head of a stringed musical instrument that allows the string to pass through the nut of the instrument and go straight to the tuning peg or machine head without the string being deflected before reaching the tuning peg or machine head. The String Alignment Plate is distinct from Spercel et al. because it does not redesign the head of the stringed instrument but allows the split head design to continue to be used while creating the same effect as the Spercel et al. design.

In U.S. Pat. No. 5,696,336, Spercel discloses a modification to a nut of a musical instrument, whereby the string passes through a set of rollers that form a notch instead of a notch in the nut. When the string is then tuned, the rollers rotate, in an attempt to reduce the friction that otherwise occurs between the nut and the string. The String Alignment Plate is distinct from Spercel in that it does not attempt to modify the design of the nut but to remove the excess friction between the nut and the string by straightening the strings path through the nut.

In U.S. Pat. No. 5,438,901, Spercel discloses a modification to a nut of a musical instrument, whereby the string passes through a set of spheres that form a notch instead of a notch in the nut. When the string is then tuned, the spheres attempt to reduce the friction that otherwise occurs between the nut and the string. The String Alignment Plate is distinct from Spercel in that it does not attempt to modify the design of the nut but to remove the excess friction between the nut and the string by straightening the strings path through the nut.

In U.S. Pat. No. 4,574,678, Edwards discloses a locking mechanism attached to the head of a musical instrument and locks a string in an attempt to eliminate the transference of tension from the string above the nut to the string below the nut. The String Alignment Plate is distinct from Edwards because does not try completely separate the tension distinctions between the string above and below the nut, but to eliminate of differential tension within a single string, thus making the string easier to tune and allow the string to stay in tune longer.

In U.S. Pat. No. 4,574,678 Lieber discloses a string nut to be used in conjunction with a "zero nut" to allow musical special effects to be created by pressing on the string above the nut while still keeping the proper lateral spacing between the strings. By adding this second nut to the head of a stringed musical instrument, Lieber potentially creates a second place where differential friction in the string can result. The String Alignment Plate is distinct from Lieber in that it is intended to eliminate of differential tension within a single string, thus making the string easier to tune and allow the string to stay in tune longer.

In U.S. Pat. No. 4,046,050 Fender discloses a string post for a musical instrument which extends perpendicularly from a machine head so as to encourage contact between the string and the nut. This maximizes contact between the string and the instrument but also maximizes the difference in string tension below the nut with that in the string above the nut. The String Alignment Plate is distinct from Fender in that it is intended to eliminate of differential tension within a single string, thus making the string easier to tune and allow the string to stay in tune longer.

In U.S. Pat. Dunnette discloses rotatable friction pegs screwed into the head of a stringed musical instrument so as to keep the string above the nut in-line with the string below the nut, thus reducing the differential tension in the string. The String Alignment Plate is distinct from Dunnette in that the pegs are affixed directly to the plate, which minimizes or eliminates the number of holes that need to be drilled into the instrument head and the spacing of the pegs are pre-determined, reducing the risk of improper placement and reducing the amount of time necessary for retrofitting where necessary.

In U.S. Pat. No. 2,771,808 Jenkins discloses a banjo tuning device designed to allow the tone of the string while playing but which is not intended to reduce or eliminate the differential tension in the string above and below the nut. The String Alignment Plate is distinct from Jenkins in that it is intended to eliminate of differential tension within a single string, thus making the string easier to tune and allow the string to stay in tune longer.

In U.S. Pat. No. 2,260,049 Nickel discloses discloses a design for the head of a stringed musical instrument that that places the tuning pegs or machine heads directly in-line and allows the string to pass through the nut of the instrument and go straight to the tuning peg or machine head without the string being deflected before reaching the tuning peg or machine head. The String Alignment Plate is distinct from Spercel et al. because it does not redesign the head of the stringed instrument but allows the split head design to continue to be used while creating the same effect as the Spercel et al. design.

In U.S. Pat. No. 2,191,776 Scheiber discloses a modification to a nut of a musical instrument, whereby the string passes through a roller that forms the notch in the nut. When the string is then tuned, the roller rotates in an attempt to reduce the friction that otherwise occurs between the nut and the string, however, the roller has vertical sides and does not prevent differential tension if the string above the nut is bent away from the alignment of the string below the nut. The String Alignment Plate is distinct from Scheiber in that it does not attempt to modify the design of the nut but to remove the excess friction between the nut and the string by straightening the strings path through the nut.

In U.S. Pat. No. 554,057 Durkee discloses a string grip in a tuning peg for a stringed musical instrument that makes it easier to attached a new string to the instrument. The String Alignment Plate is distinct from Durkee in that it does not attempt to make it easier to attached a new string to an instrument but to eliminate of differential tension within a single string, thus making the string easier to tune and allow the string to stay in tune longer.

SUMMARY OF THE INVENTION

A String Alignment Plate is affixed to the head of a stringed musical instrument Pegs on the String Alignment Plate keep that portion of the string above the nut of the instrument in-line or parallel with the same string which extends from the bridge to the nut, thus minimizing the friction that is otherwise created at the nut in the instance where the string must bend at the nut in order to reach the tuning peg or machine head. The each Peg of the String Alignment Plate is either a solid cylindrical peg or free-floating roller surrounding a central axis, either of which has a top portion of greater diameter than the main body portion of the Peg to prevent a string from slipping off the peg. The Peg is affixed to a truss rod cover or similar plate and the String Alignment Plate is then affixed to the head of a stringed musical instrument.

DETAILED DESCRIPTION OF THE INVENTION

Figure 1:
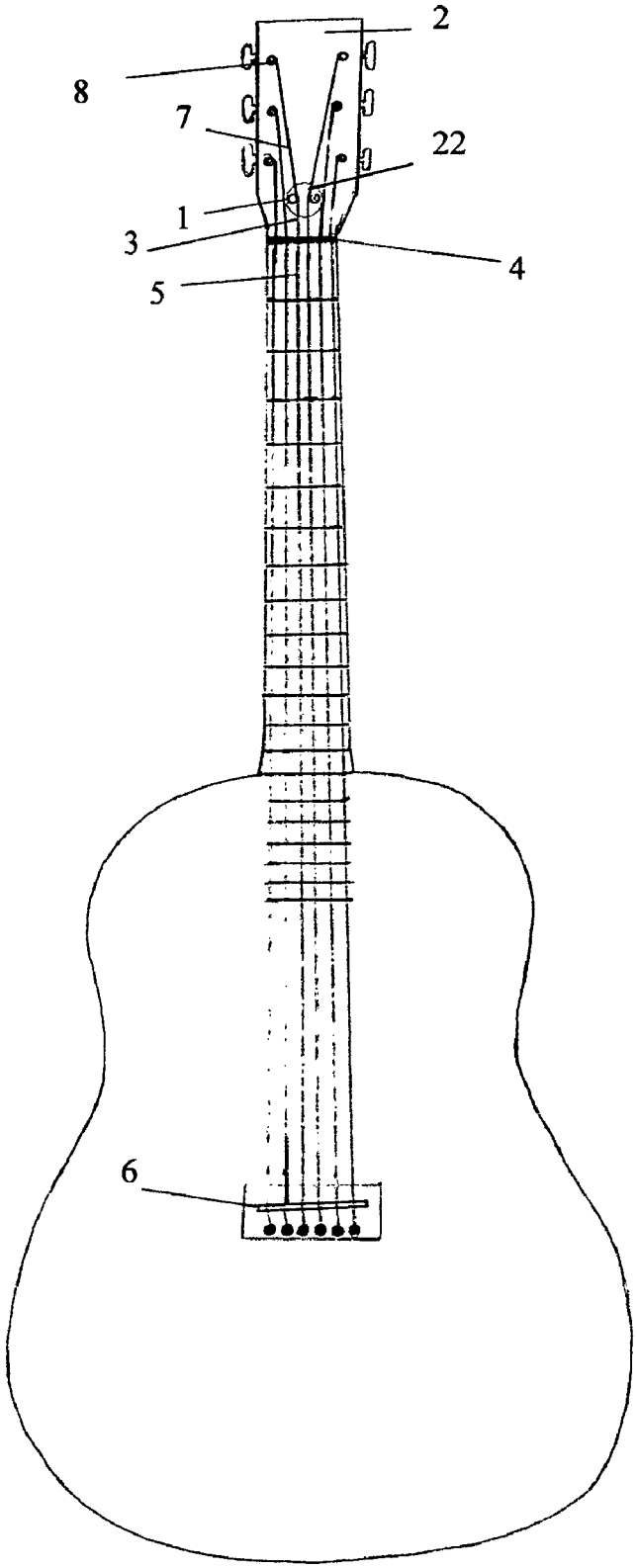
FIG. 1 is a view of the neck and head of a guitar with strings traversing from the bridge, along the neck to the nut, through the nut to the Peg on the String Alignment Plate, the Peg then keeps that portion of the string above the nut in-line with the same string as it extends from the bridge to the nut, at the Peg the string then curves around the Peg to the tuning peg or machine head.
Figure 2:
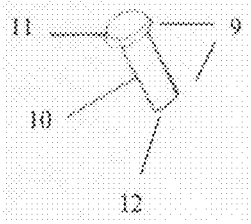
FIG. 2 is a view of a Peg that is in the form of a Solid Cylindrical Peg with a top of greater diameter than the body.
Figure 4:
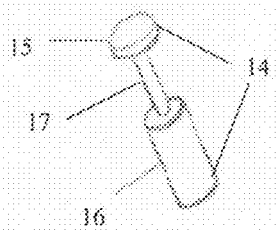
FIG. 4 is a view of a Peg in the form of a Free-Floating Peg with a top of greater diameter than the body and roller around a central axis.
Figure 5:
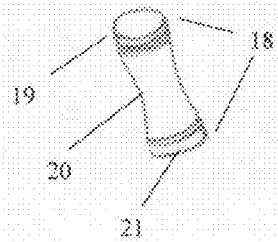
FIG. 5 is a view of a Peg where the top and body portion form an Hourglass Shaped Peg.
Figure 3:
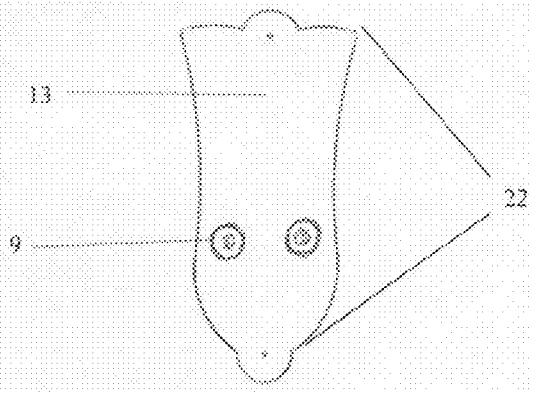
FIG. 3 is a view of a String Alignment Plate where the Peg is affixed directly onto a truss rod cover.

A String Alignment Plate 22 is made up of a Peg 1 and a truss rod cover or similar plate 13, which is to be used with stringed musical instruments to minimize the friction that is otherwise created in that portion of the string above the nut 4 when a string passes through the nut of the instrument and is then bent in order to reach the instrument's tuning pegs or machine heads 8.

The String Alignment Plate 22 is affixed to the head 2 of the musical instrument such that the Pegs 1 on the String Alignment Plate keep the string 3 above the nut 4 in-line or parallel with the same string 5 that extends from the bridge 6 to the nut 4. The string 7 then curves around the String Alignment Plate to the tuning peg or machine head 8.

A Peg has three different embodiments. The first embodiment is a Solid Cylindrical Peg 9, which is made up of a head portion 11 larger than the body portion 10 and base 12 at the end opposite the head portion that is affixed to a truss rod cover or similar plate 13.

The second embodiment is a Free Floating Peg 14, which is made up of a head portion 15, a hollow free-floating roller 16 around a central axis 17 that is just slightly smaller than the hollowed portion of the free-floating roller so that the free-floating roller can rotate around the axis, with a base at the end opposite the top that is affixed to a truss rod cover or similar plate 13. The third embodiment of the Peg is an Hourglass Shaped Peg 18 with a head portion 19, an hourglass shaped body 20 and a base 21 at the end opposite the top that is affixed to a truss rod cover or similar plate 13.

What is claimed is:

1. A string alignment plate designed so that it causes that portion of a string from the nut in the head region of a stringed musical instrument to stay in-line or parallel with that portion of the same string that extends from the bridge to the nut comprising:

a. a solid cylindrical peg, with a top that is of greater diameter than the body, an end opposite the top;

b. a truss rod cover or similar plate with a top face and bottom face opposite the top face; and c. wherein the end opposite the top of the solid cylindrical peg is affixed perpendicularly to the top face of said truss rod cover or similar plate in such a position that when the plate is affixed onto the head of an instrument, a string going from the nut to the solid cylindrical peg remains in-line or parallel with that portion of the same string that extends from the bridge to the nut, the string then curves around the solid cylindrical peg to a tuning peg or machine.

2. The string alignment plate of claim 1 where the top, and body portion of the solid cylindrical peg form an hourglass shaped, with an end opposite the top.

3. The string alignment peg of claim 1 where the solid cylindrical peg is replaced with a free-floating peg such that the free-floating peg comprising: a hollow cylinder, and modified peg with a top that is larger than the outer diameter of a hollow cylinder, a central axis just slightly smaller than the hollow of the hollow cylinder so that the hollow cylinder can rotate around the central axis, and a base at the end opposite the top, the modified peg is then inserted through the hollow cylinder prior to attaching the free-floating peg to the truss rod cover or similar plate.

* * * * *